US006009568A

United States Patent [19]

Miyazaki

[11] Patent Number: 6,009,568

[45] Date of Patent: Jan. 4, 2000

[54] OPENING-CLOSING DEVICE OF WESTERN STYLE TOILET SEAT AND SEAT COVER

[75] Inventor: Kanetsugu Miyazaki, Kanegawa, Japan

[73] Assignee: Katoh Electrical Machinery Co., Ltd., Kanagawa, Japan

[21] Appl. No.: 09/009,450

[22] Filed: Jan. 20, 1998

[30] Foreign Application Priority Data

Jan. 24, 1997 [JP] Japan ..... 9-011435

[51] Int. Cl.[7] ..... A47K 13/12

[52] U.S. Cl. ..... 4/236; 4/240; 4/248; 4/241

[58] Field of Search ..... 4/234–237, 240, 4/241, 242.1, 246.1, 246.2, 248; 16/303, 305, 306, 307, 308

[56] References Cited

FOREIGN PATENT DOCUMENTS 5-285066 11/1993 Japan ..... 4/236

*Primary Examiner*—Henry J. Recla
*Assistant Examiner*—Tuan Nguyen
*Attorney, Agent, or Firm*—Notaro & Michalos P.C.

[57] ABSTRACT

An opening-closing device for a Western style toilet seat and seat cover is disclosed, in which a pair of hinge cases are mounted at a predetermined spacing at the rear upper end of a Western style toilet bowl; in either of the pair of hinge cases a rotating shaft for the seat and a rotating shaft for the seat cover are rotatably mounted; on the rotating shaft for the seat in either hinge case, the seat mounting section is rotatably mounted, and on the rotating shaft for the seat cover in the hinge case, the seat cover mounting section is rotatably mounted; and a rotation control mechanism is mounted on the rotating shaft for the seat and the rotating shaft for the seat cover, to thereby prevent sudden drop of the seat and seat cover, At this time, the rotation control mechanism may be a cam mechanism using a compression spring, a torsion spring, a rotation camper, or a friction mechanism. Furthermore, the cam mechanism may be comprised of a stationary cam fixed on a partition wall provided in the hinge case with the rotating shaft inserted in the center, a rotating-sliding cam which is disposed oppositely to the stationary cam and can slide in the axial direction of the rotating shaft while rotating together with the rotating shaft, and a compression spring for pressing the rotating-sliding cam towards the stationary cam side.

9 Claims, 12 Drawing Sheets

OPENING-CLOSING DEVICE OF WESTERN STYLE TOILET SEAT AND SEAT COVER

BACKGROUND OF THE INVENTION

1. Field of the Invention

The present invention relates to an opening-closing device suitable for use particularly in opening and closing Western style toilet seat and seat cover.

2. Description of the Related Art

As this type of opening-closing device, a pair of opening-closing devices having a rotating shaft fitted with a rotation control means have been known. These devices are mounted at a specific spacing at the rear upper end of the toilet bowl in order to prevent abrupt drop of the seat and seat cover. One of the opening-closing devices is for the toilet seat, while the other is for the seat cover. In the prior art opening-closing device, a mounting section of the seat is secured on one mounting shaft portion of the rotating shaft and at the same time the mounting section of the seat cover is rotatably supported. Also on the mounting shaft portion of the other rotating shaft, the other mounting section of the seat is rotatably supported and the mounting section of the seat cover is secured, so that either opening-closing device will operate when either the seat or the seat cover is opened or closed.

In the prior art opening-closing device, the mounting shaft portion of the rotating shaft to be coupled to the mounting section of the seat and the seat cover and the mounting pin of the seat and seat cover to be inserted into an irregular mounting hole provided axially in the rotating shaft are irregular shafts of approximately elliptical section which are formed by cutting off their both sides. The irregular shaft is fixed in one irregular hole of the seat and seat cover mounting section, and inserted into a round hole. Therefore there arises such a disadvantage that the seat and seat cover are likely to vibrate more or less when opened or closed, and since the opening-closing device with the rotation control means acts only on one side of the seat and seat cover mounting section.

SUMMARY OF THE INVENTION

It is an object of the present invention to provide an opening-closing device which ensures well-balanced operation of the seat and seat cover.

It is another object of the present invention to provide an opening-closing device so constituted as to prevent vibration when the seat and seat cover is opened or closed.

It is further another object of the present invention to provide an opening-closing device capable of imparting clear-cut outside appearance when the device is mounted on a Western style toilet bowl.

To accomplish the above-described objects, a pair of hinge cases are mounted at a predetermined spacing at the rear upper end of the Western style toilet bowl; in either of the pair of hinge cases the rotating shaft for the seat and the rotating shaft for the seat cover are rotatably mounted separately; on the rotating shaft for the seat in either hinge case, the seat mounting section is rotatably mounted; on the rotating shaft for the seat cover in the hinge case, the seat cover mounting section is rotatably mounted; and a rotation control means is mounted on the rotating shaft for the seat and the rotating shaft for the seat cover, to thereby prevent sudden drop of the seat and seat cover.

According to the present invention, a pair of hinge cases are mounted at a predetermined spacing at the rear upper end of the Western style toilet bowl; in either of the pair of hinge cases, a pair of rotating shafts for the seat and the seat cover are rotatably mounted; a rotation control means is provided on only one of the rotating shafts for the seat and the seat cover; and the seat and seat cover mounting sections are rotatably mounted on the rotating shaft on which the rotation control means is provided, and on the other rotating shaft.

It is to be noticed that, in the present invention, the rotation control means may be a cam mechanism provided with a compression spring.

Furthermore, the cam mechanism may be comprised of a stationary cam fixed on a partition wall provided in the hinge case with the rotating shaft inserted in the center, a rotating-sliding cam which is disposed oppositely to the stationary cam and can slide in the axial direction of the rotating shaft while rotating together with the rotating shaft, and a compression spring for pressing the rotating-sliding cam towards the stationary cam side.

Furthermore, in the present invention, the rotation control means may be a torsion spring, a rotation damper, or a friction mechanism.

Furthermore, in the present invention, a pair of hinge cases, when mounted at the rear upper end of the toilet bowl, can be releasably mounted on a hinge holder mounted at the rear upper end of the toilet bowl.

At this time, in the present invention, the hinge case, when removably mounted to the case holder, may be comprised of a leg which is releasably engaged with the case holder for holding the hinge case to restrict the vertical movement of the hinge case fitted in the case holder, and a locking piece inserted between the hinge cases in the case holder for restricting the lateral movement of the hinge case fitted in the case holder.

Furthermore, in the present invention, when the hinge case is removably installed to the case holder, the hinge case can be unitarily formed with the leg and fitted in the case holder, and then the locking piece can be inserted between the hinge cases to thereby restrict the lateral movement of the hinge case.

DESCRIPTION OF THE PREFERRED EMBODIMENTS

Figure 1:
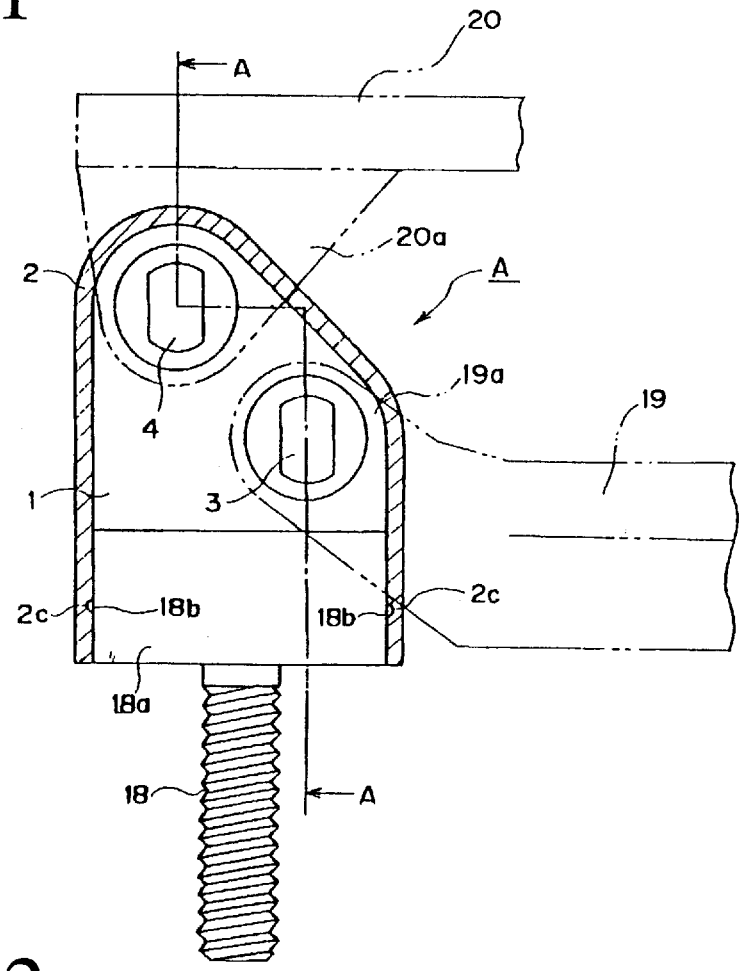
FIG. 1 is a side sectional view of a Western style toilet seat and seat cover opening-closing device according to the present invention.
Figure 2:
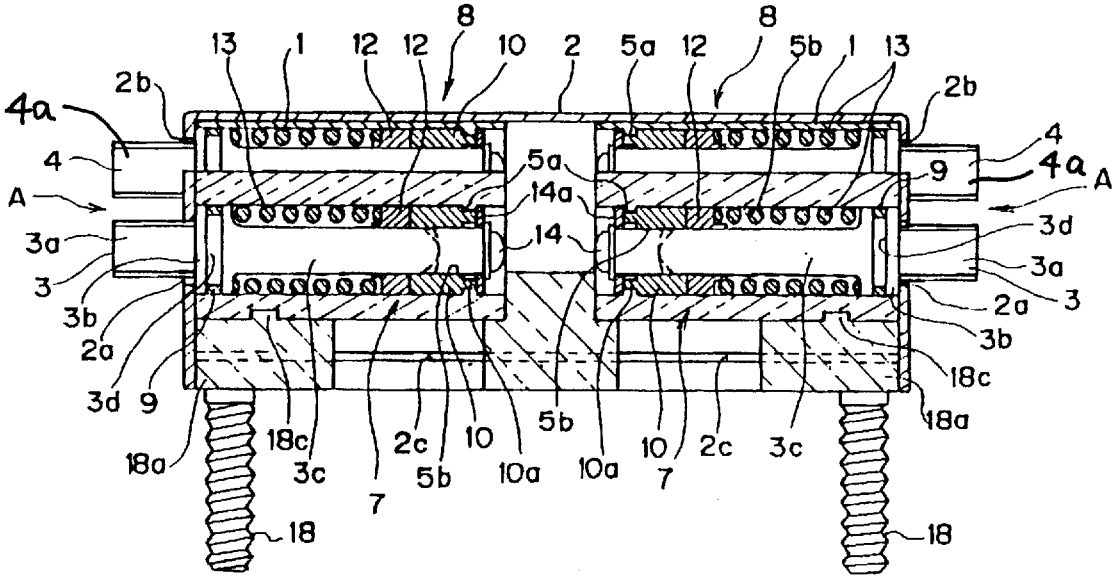
FIG. 2 is a sectional view taken along line A—A of FIG. 1.
Figure 3:
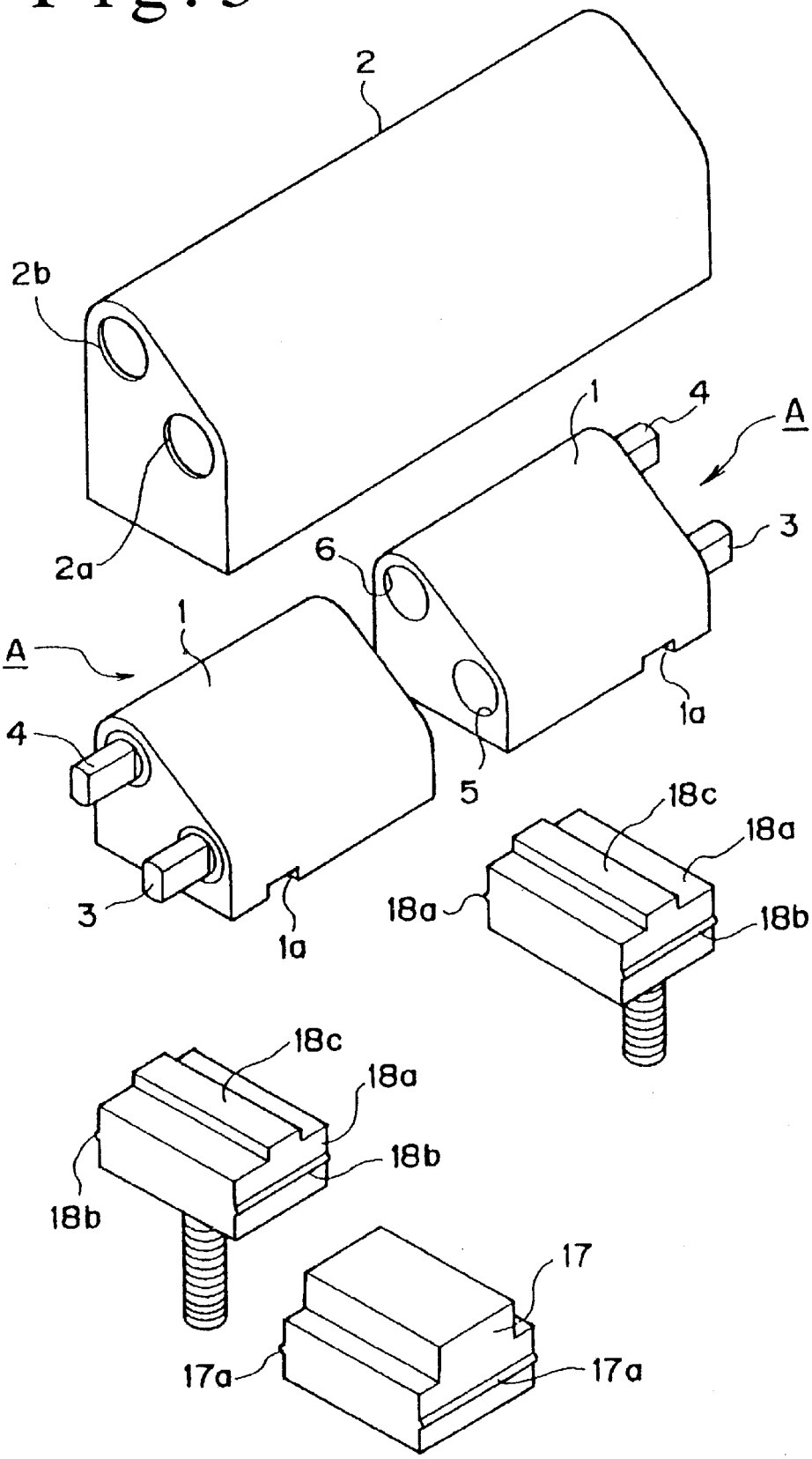
FIG. 3 is an exploded perspective view of a major portion of the Western style toilet seat and seat cover opening-closing device according to the present invention.
Figure 4:
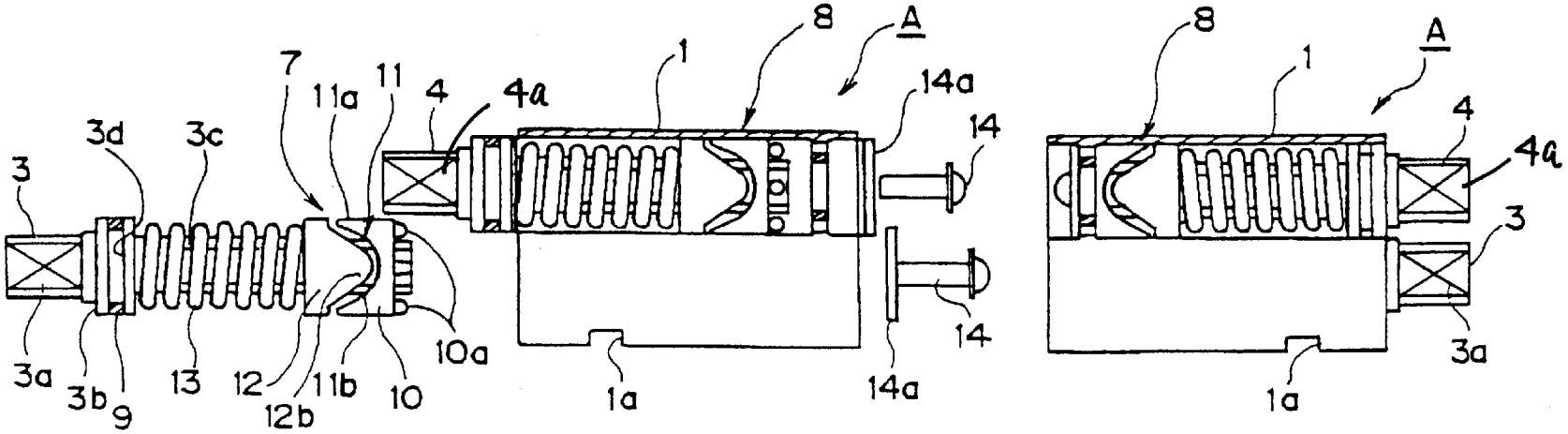
FIG. 4 is a partly exploded perspective view, partly in section, of a rotation control means of the Western style toilet seat and seat cover opening-closing device according to the present invention.
Figure 5:
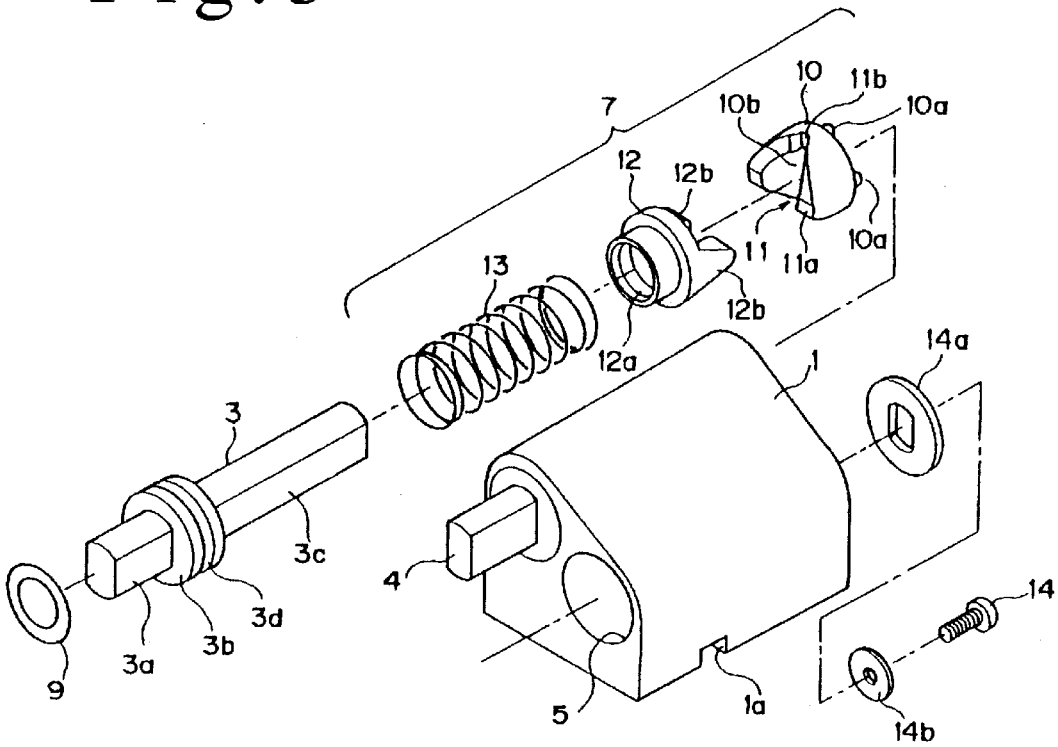
FIG. 5 is a partly exploded perspective view of a rotation control means of the Western style toilet seat and seat cover opening-closing device according to the present invention.

One embodiment of the present invention is shown in the accompanying drawings. In FIGS. 1 to 3, reference numerals 1, 1 denote hinge cases of opening-closing devices A, A; and numeral 2 refers to a case holder in which a pair of hinge cases 1, 1 are removably housed. On both sides of the case holder 2, there are provided a pair of seat rotating shafts 3, 3 protruding from one side of the hinge cases 1, 1 and a pair of insertion holes 2*a*, 2*b* into which seat cover rotating shafts 4, 4 are inserted.

The right and left opening-closing devices A, A are the same in internal construction; therefore only the left opening-closing device will be explained. The hinge case 1 of the left opening-closing device A is provided with a first mounting hole 5 for a seat rotating shaft 3 and a second mounting hole 6 for a seat cover rotating shaft 4. In these mounting holes 5 and 6, the seat rotating shaft 3 and the seat cover rotating shaft 4 are rotatably mounted. The rotating shafts 3 and 4 are provided with rotation control means 7 and 8. The rotating shafts 3 and 4 are the same in shape and construction and also the rotation control means 7 and 8 the same in shape and construction as described later. Only the difference lies in the shape of the stationary cam. Hereinafter, therefore, the seat rotating shaft 3 and the rotation control means 7 for the rotating shaft 3 will be described.

In FIGS. 4 to 8, a portion of the rotating shaft 3 which protrudes from the hinge case 1 is an irregular mounting shaft portion 3*a* having an approximately elliptical section formed by cutting its both sides off. The rotating shaft 3 has, in a portion housed in the hinge case 1, a large-diameter portion 3*b* at the inlet area of the hinge case 1 and a small-diameter portion 3*c* having an approximately elliptical section formed by cutting its both sides continuously to the large-diameter portion 3*b*. The rotating shaft 3 is supported at the large-diameter portion 3*b* on a bearing in the inlet of the first mounting hole 5 formed through the hinge case 1, and is rotatably mounted in the hinge case 1. An O-ring 9 is fitted in a peripheral groove 3*d* provided in the outer periphery of the large-diameter portion 3*b*.

Within the first mounting hole 5 is mounted the rotation control means 7 of the rotating shaft 3 comprising a cam mechanism. The constitution of the rotation control means 7 is as described below.

First, a plurality of engaging holes 5*c* are provided in a partition wall 5*a* formed in the first mounting hole 5. In the engaging holes 5*c* an engaging projection 10*a* projecting from one side of the partition wall 5*a* is inserted and fixed to prevent rotation of the stationary cam 10. On the other side of the stationary cam 10 is formed a cam portion 11 which consists of a convex portion 11*a* and a concave portion 11*b*, and the small-diameter portion 3*c* is rotatably inserted into the insertion hole 5*b* provided in the center.

Oppositely to the cam portion 11 of the stationary cam 10 is mounted a rotating-sliding cam 12. The rotating-sliding cam 12 is rotatable and slidable together with the rotating shaft 3 with the small-diameter portion 3*c* of the rotating shaft 3 inserted and locked in an irregular hole 12*a* formed in the center of the cam portion 11. A convex portion 12*b* is provided in a position in which the rotating-sliding cam 12 faces the cam portion 11 of the stationary cam 10.

Between the rotating-sliding cam 12 and the large-diameter portion 3*b* of the rotating shaft 3, a compression spring 13 wound over the small-diameter portion 3*c* is elastically mounted, constantly pressing the rotating-sliding cam 12 toward the stationary cam 10 side. For the compression spring 13, a plate spring is also usable.

On the side where the rotating shaft 3 is mounted through the partition wall 5*a*, a mounting screw 14 is installed through a lock plate 14*a*, thereby preventing accidental axial removal of the rotating shaft 3 from the first mounting hole 5. Numeral 14*b* denotes a washer.

Figure 9:
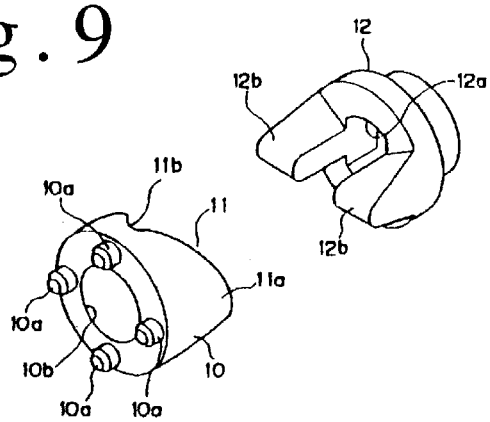
FIG. 9 is a perspective view explaining a cam mechanism of the rotation control means of the Western style toilet seat and seat cover opening-closing device according to the present invention.
Figure 10:
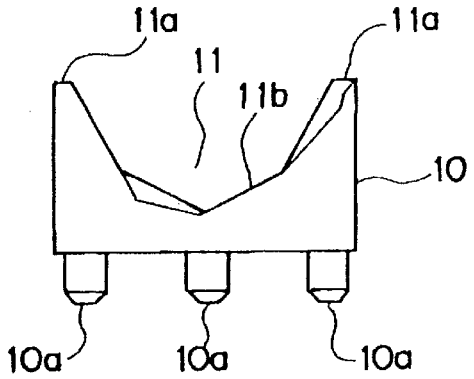
FIG. 10 is a front view of a stationary cam of the rotation control means for the seat of the Western style toilet seat and seat cover opening-closing device according to the present invention.
Figure 11:
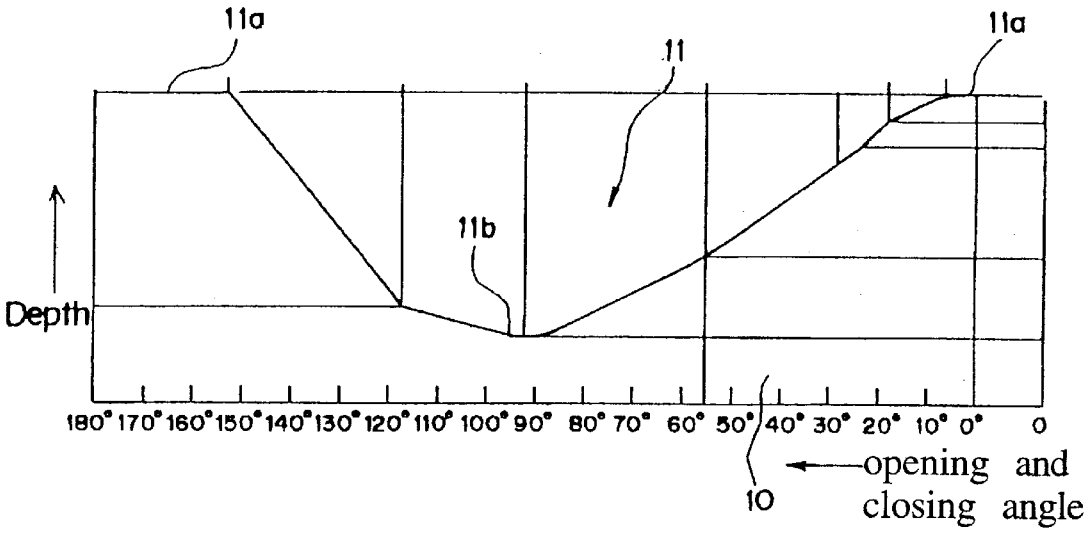
FIG. 11 is a development of a cam portion of the stationary cam shown in FIG. 10.
Figure 12:
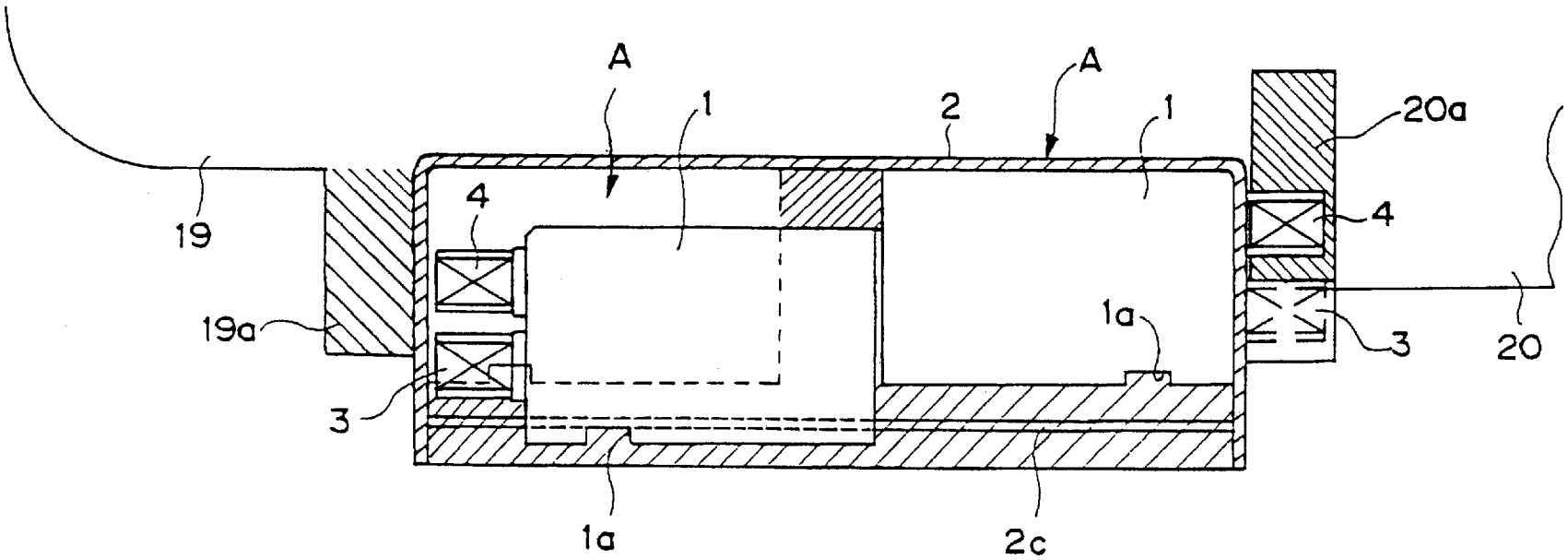
FIG. 12 is an explanatory view explaining a procedure for assembling the hinge section of the Western style toilet seat and seat cover opening-closing device according to the present invention.
Figure 13:
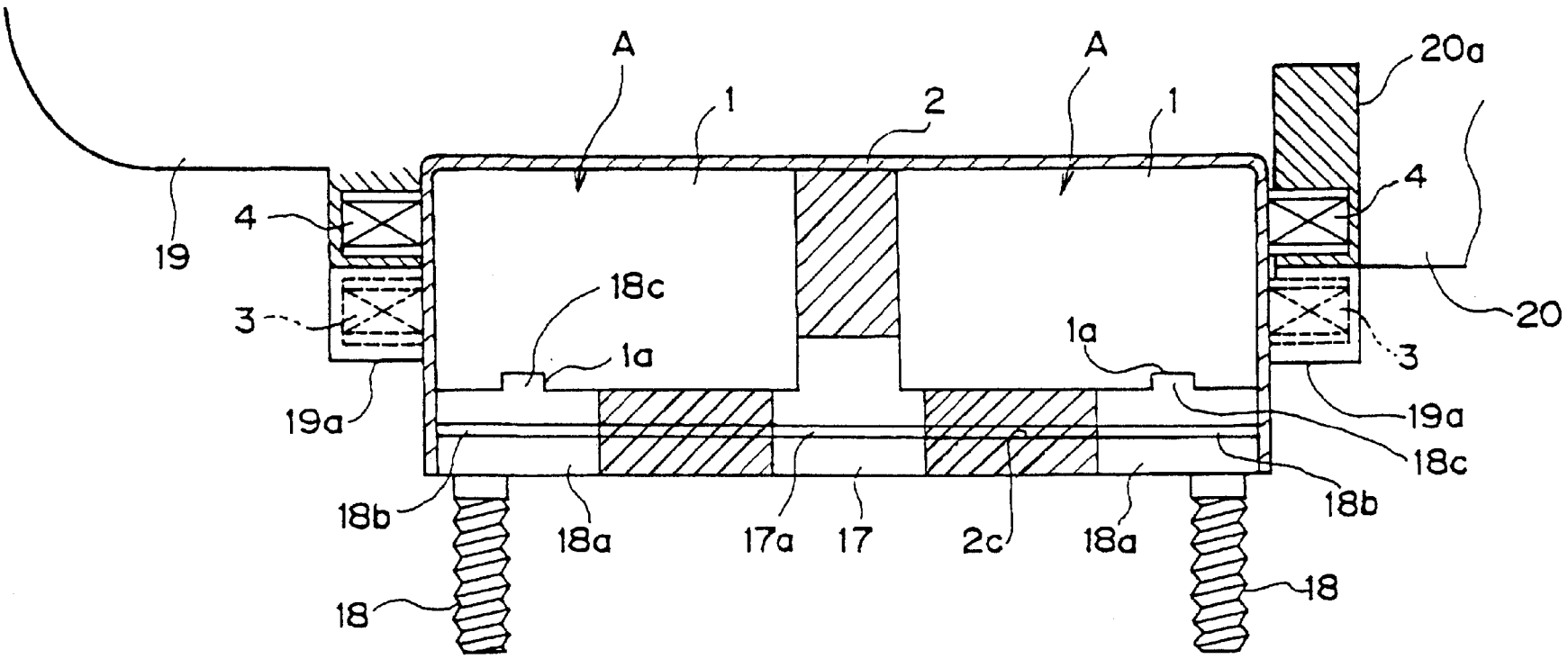
FIG. 13 is an explanatory view explaining a procedure for assembling the hinge section of the Western style toilet seat and seat cover opening-closing device according to the present invention.
Figure 14:
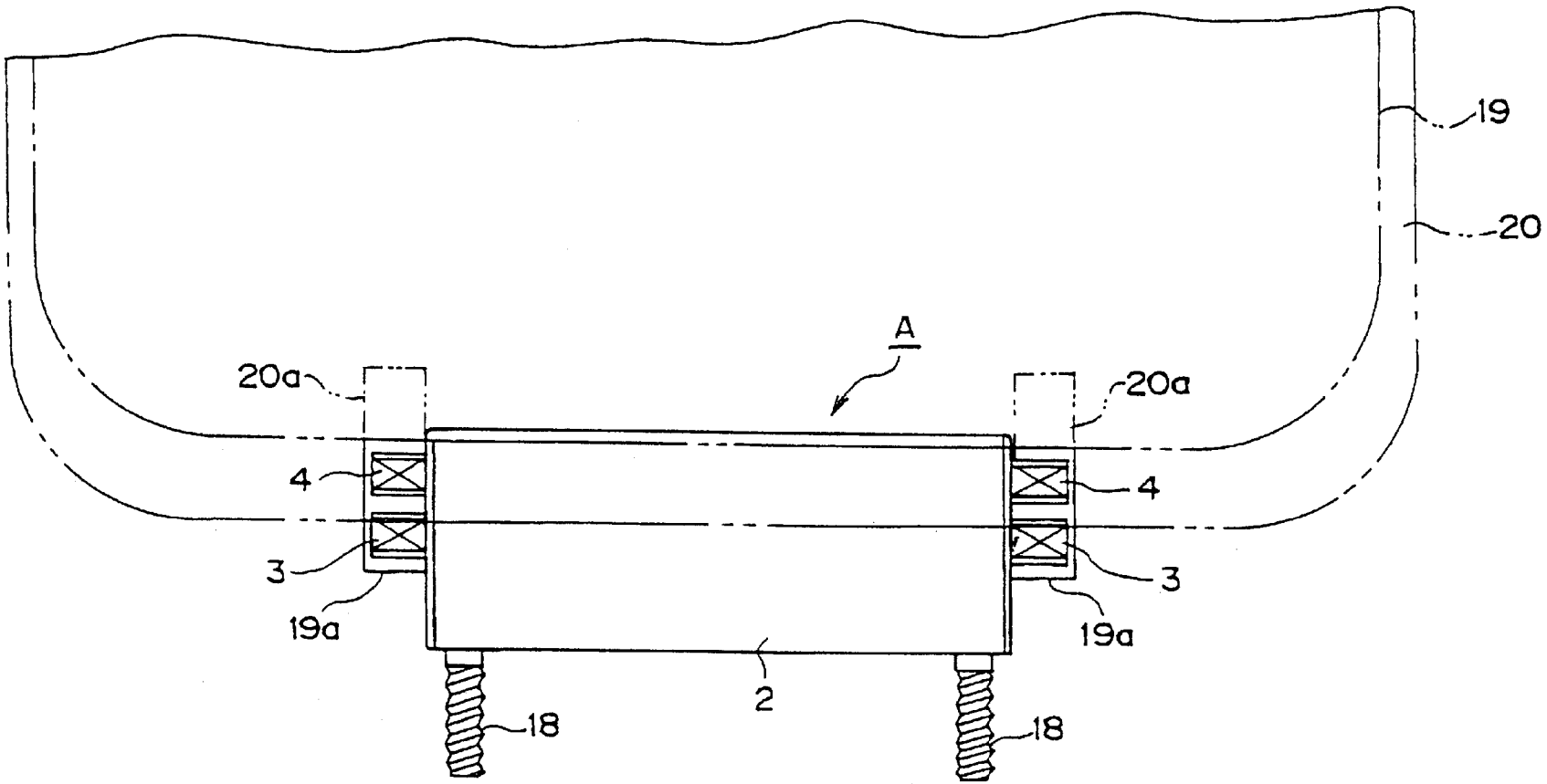
FIG. 14 is an explanatory view explaining a procedure for assembling the hinge section of the Western style toilet seat and seat cover opening-closing device according to the present invention.

The cam portion 11 of the stationary cam 10 used in the rotation control means 7 for the seat rotating shaft 3 and the cam portion 11 of the stationary cam 10 used in the rotation control means 8 for the seat cover rotating shaft 4 differ only in the inclination angle mainly of the concave and convex portions 11*b* and 11*a* and make no big difference in shape, particularly in the shape of their convex portion 11*a* and the cam portion 11 as shown in FIGS. 9 to 11. This is chiefly due to a difference in weight between a seat 19 and a seat cover 20 and a difference in the feeling of operation required (FIGS. 12 to 14).

Next, a means for installing and removing the case holder 2 of the hinge cases 1, 1 will be explained. As shown in FIGS. 12 to 14, first the hinge cases 1, 1 are inserted from under the case holder 2, with the mounting shaft portions 3*a* and 4*a* of the seat and seat cover rotating shafts 3 and 4 protruded outwards from the insertion holes 2*a*, 2*b* provided in the both sides.

Next, a locking piece 17 is inserted into the space between the hinge cases 1, 1 through the lower middle part of the case holder 2. Furthermore, fixing portions 18*a*, 18*a* of the legs 18, 18 consisting of screw rods are similarly inserted from both sides under the case holder 2, and at the same time an engaging projecting portion 18*c* is fitted in the engaging groove 1*a*. Then, protruding keys 17*a* and 18*b* provided on the front and rear sides are fitted in keyways 2*c* provided in the front and rear of the lower inner periphery of the case holder 2.

Now the mounting of the hinge cases 1, 1 to the case holder 2 has been completed. When the rotating shafts 3 and 4 are protruded out of the insertion holes 2*a*, 2*b* in both sides of the case holder 2 in mounting the hinge cases 1, 1 to the case holder 2, it is advised that the case holder 2 be secured to the mounting sections 19*a*, 19*a* and 20*a*, 20*a* of the seat 19 and the seat cover 20. In this case, irregular mounting holes of the mounting sections which fit to the shape of the mounting shaft portions 3*a*, 3*a* and 4*a*, 4*a* of the rotating shafts 3 and 4 are provided in the mounting sections 19*a*, 19*a* and 20*a*, 20*a* of the seat 19 and the seat cover 20, and also the mounting sections 19*a*, 19*a* and 20*a*, 20*a* are secured to both the pair of rotating shafts 3 protruded from the hinge cases 1, 1 and the rotating shaft 4 for the seat cover. Therefore when the seat 19 and the seat cover 20 are opened and closed, the seat rotating shaft 3 and the seat cover rotating shaft 4 of the right and left opening-closing devices A, A rotate. The hinge case 1 can be removed from the case holder 2 by reversing the procedure described above.

Figure 15:
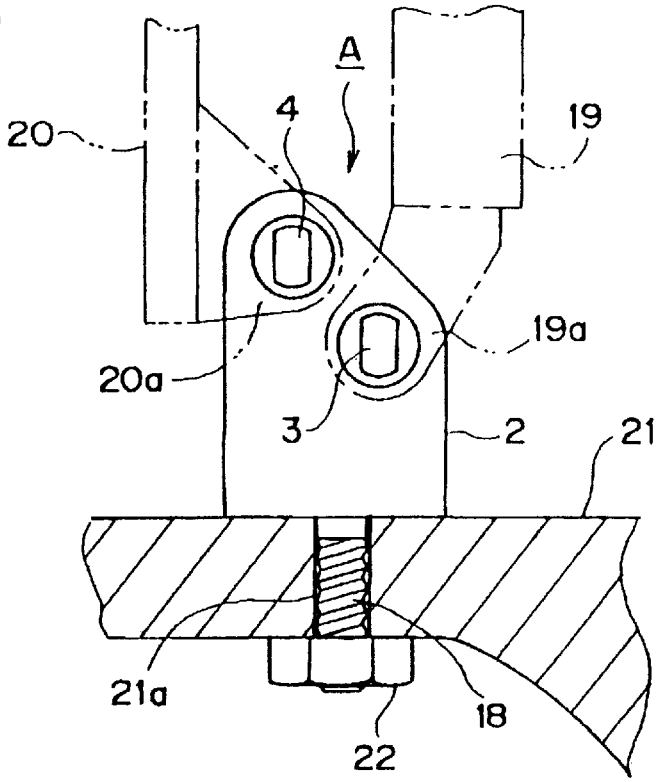
FIG. 15 is a partly sectional view showing the Western style toilet seat and seat cover opening-closing device according to the present invention mounted on a Western style toilet bowl.

Next, holding by hand the case holder 2 mounted with the hinge cases 1, 1 fitted with the seat 19 and the seat cover 20, the legs 18, 18 are inserted into mounting holes 21*a* provided in the toilet bowl 21 and fastened by a nut 22, thus completing the installation of the seat 19 and the seat cover to the toilet bowl 21 (FIG. 15)

Figure 6:
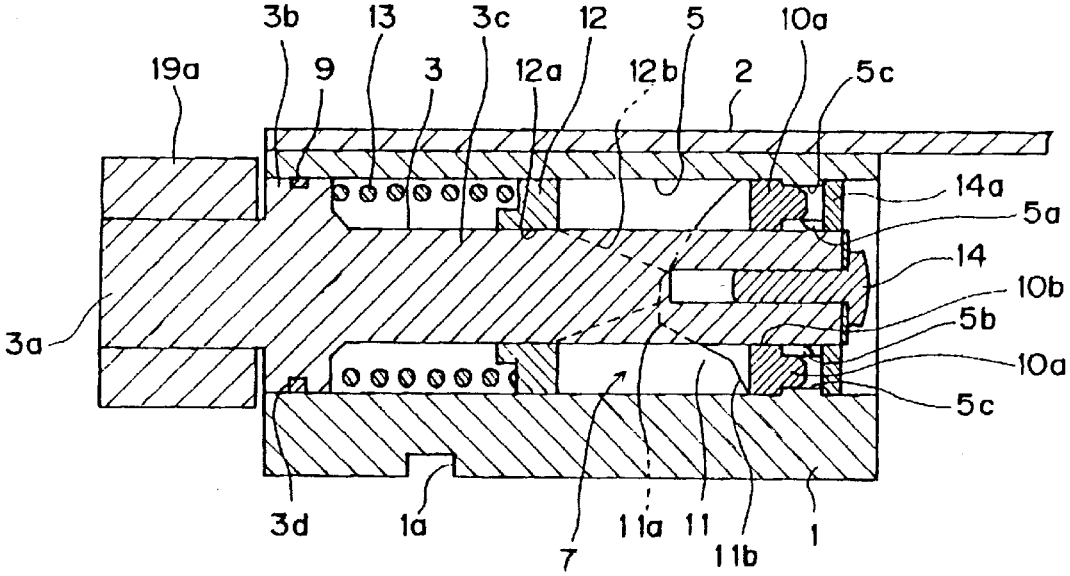
FIG. 6 is a longitudinal sectional view of the rotation control means of the Western style toilet seat and seat cover opening-closing device according to the present invention.
Figure 7:
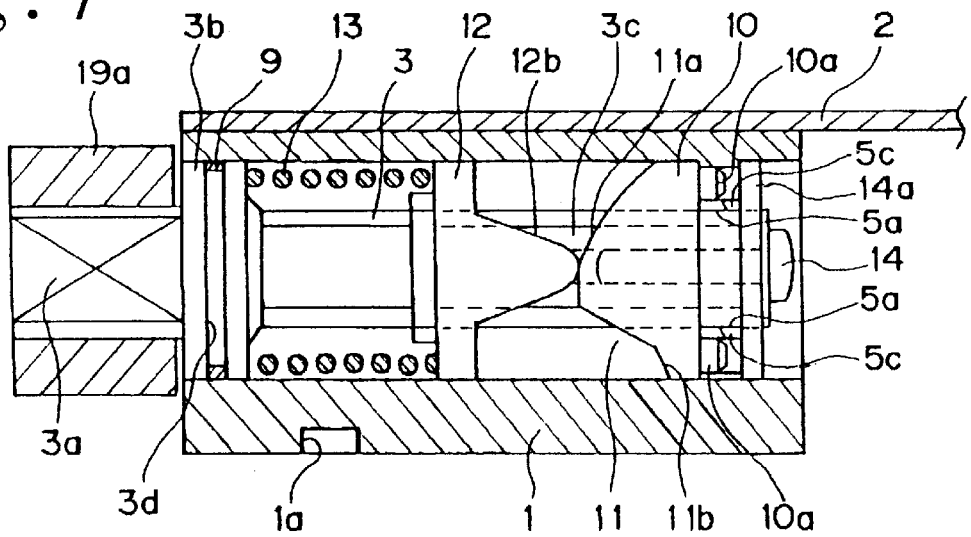
FIG. 7 is a sectional view explaining the operation of the rotation control means of the Western style toilet seat and seat cover opening-closing device according to the present invention.
Figure 8:
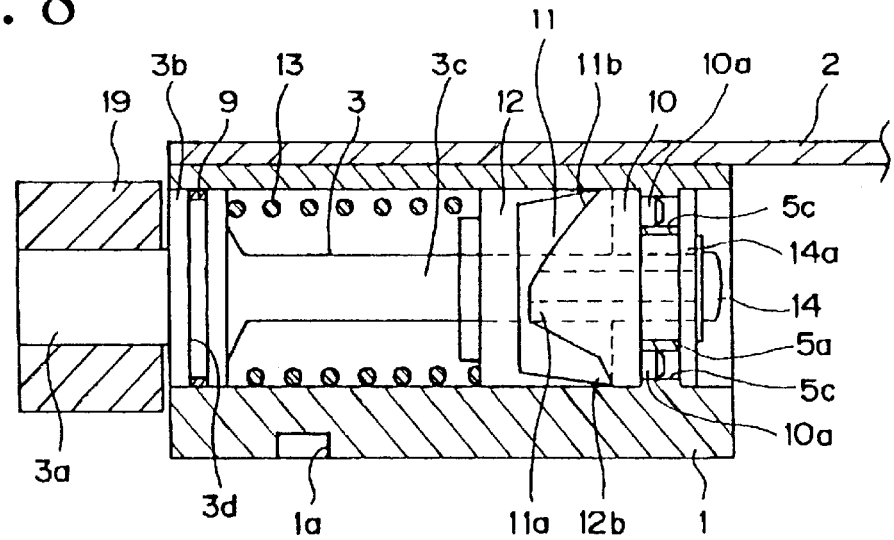
FIG. 8 is a sectional view explaining the operation of the rotation control means of the Western style toilet seat and seat cover opening-closing device according to the present invention.

Next, operation of the opening-closing device A will be explained. As shown in FIG. 1, when the seat 19 is in a closed state as indicated by an imaginary line, the convex portion 12*b* of the rotating-sliding cam 12 which constitutes the cam mechanism of the seat rotation control means 7 shown in FIGS. 6 and 7 is in contact with the convex portion 11*a* of the cam portion 11 of the stationary cam 10. In this state, the compression spring 13 is fully compressed. When the seat 19 is opened from this state, the rotating shaft 3 rotates through the irregular mounting shaft portion 3*a* which is engaged with the mounting section 19*a*. As shown in FIG. 8, the convex portion 12*b* of the rotating-sliding cam 12 which rotates in the same direction as the rotating shaft 3 turns from the convex portion 11*a* down to the concave portion 11*b* of the cam portion 11 of the stationary cam 10, sliding toward the stationary cam 10 side. In the present embodiment, as shown in FIG. 11, the toilet seat inclines reversely from the opening angle of 90 degrees, being braked.

When the seat 19 is closed from its opened position, the cam mechanism of the rotation control means 7 turns in the reverse direction of the above-described operation. As shown in FIG. 11, when the convex portion 12*b* of the rotating-sliding cam 12 turns from the closed angle of about 90 degrees to change the contact position from the concave portion 11*b* of the cam portion 11 of the stationary cam 10 against the elastic force of the compression spring 13, there is produced resistance. By the presence of this resistance there occurs a reverse torque which cancels the turning moment of the seat 19, thus checking abrupt closing of the seat 19. In the present embodiment, from a closing angle of about 25 degrees the seat tends to tilt slightly quickly. To prevent this the brake is applied to the seat. From 20 degrees the inclination becomes gentle, allowing the seat to close slightly quickly.

Figure 16:
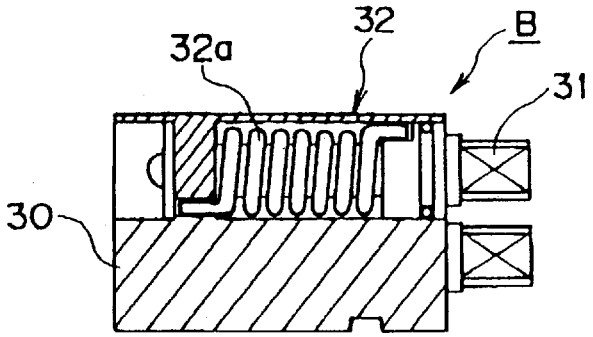
FIG. 16 is an explanatory view showing another embodiment of the rotation control means.

FIG. 16 shows another embodiment of the opening-closing device to be mounted within the case holder. In the hinge case 30 of the opening-closing device B of the present embodiment, a rotation control means 32 for controlling the rotation of the rotating shaft 31 which rotates with the opening-closing operation of the seat cover is composed only of a torsion spring 32*a*. The internal structure of the rotation control means for the seat, being the same as that for the seat cover, will not be illustrated.

Figure 17:
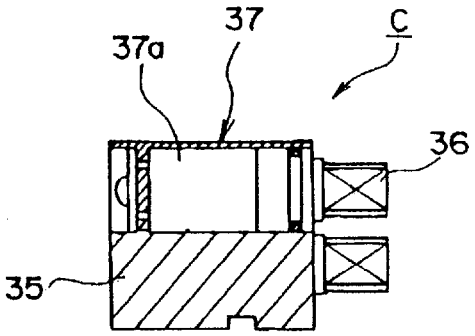
FIG. 17 is an explanatory view showing further another embodiment of the rotation control means.

FIG. 17 shows further another embodiment of the opening-closing device to be mounted within the case holder. Within a hinge case 35 of the opening-closing device C of the present embodiment, a rotation control means 37 for controlling the rotation of a rotating shaft 36 which rotates with the opening-closing operation of the seat cover is composed of a rotation damper 37*a*. The internal structure of the rotation control means for the seat, being the same as that for the seat cover, will not be illustrated.

Figure 18:
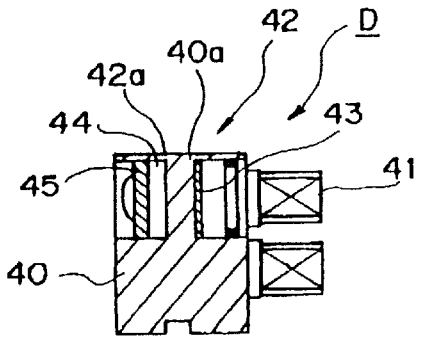
FIG. 18 is an explanatory view showing further another embodiment of the rotation control means.

FIG. 18 shows further another embodiment of the opening-closing device to be mounted within the case holder. Within a hinge case 40 of the opening-closing device D of the present embodiment, a rotation control means 42 for controlling the rotation of a rotating shaft 41 which rotates with the opening-closing operation of the seat cover is composed of a friction mechanism 42*a* which comprises a friction plate 43 to be pressed against a partition wall 40*a*, a spring washer 44, and a thrust washer 45. It should be noted that the constitution of the friction mechanism 42*a* is not limited to that of the present embodiment. The internal structure of the rotation control means for the seat, being the same as that for the seat cover, will not be illustrated.

Figure 19:
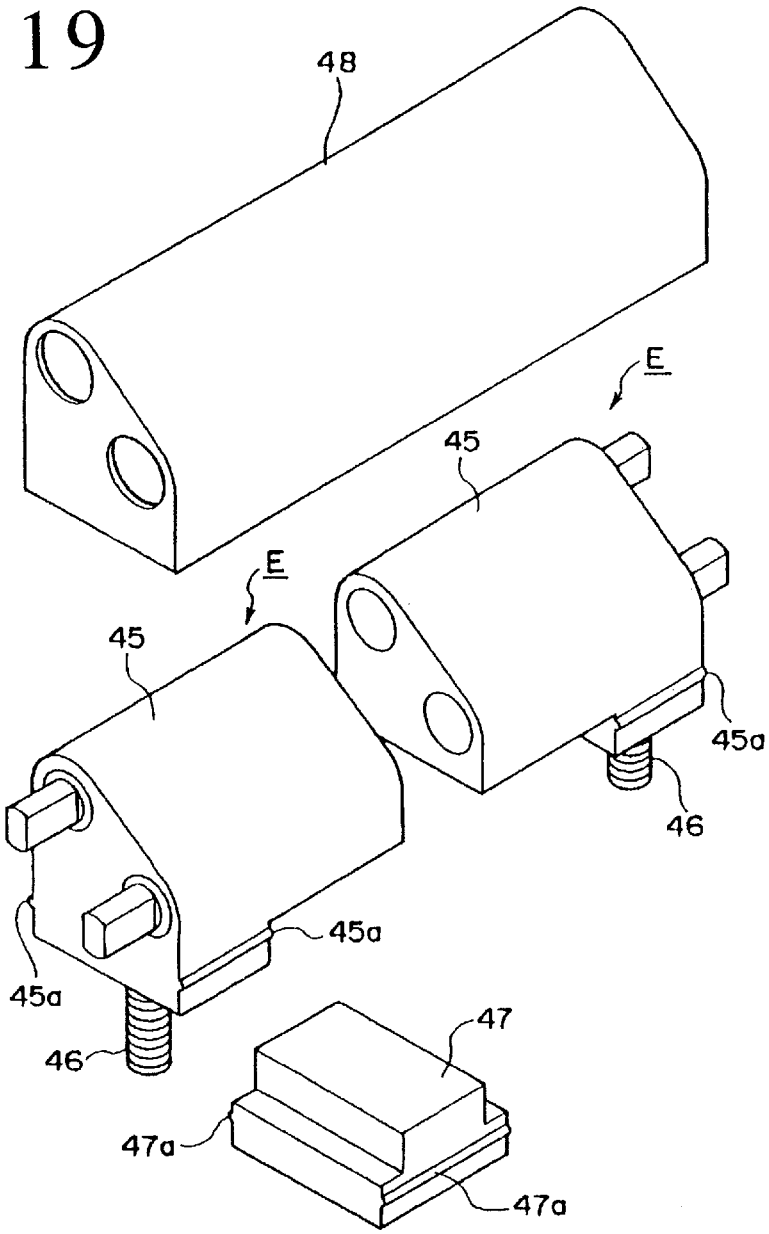
FIG. 19 is an exploded perspective view showing another embodiment of the Western style toilet seat and seat cover opening-closing device according to the present invention.
Figure 20:
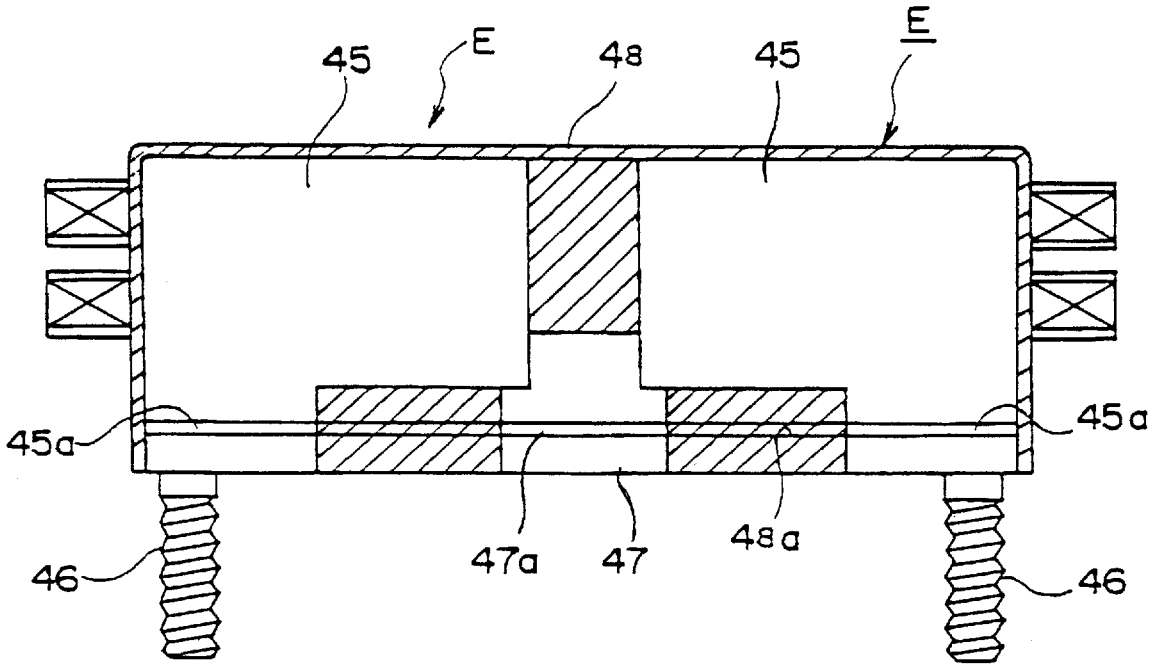
FIG. 20 is an explanatory view for explaining a procedure for assembling the Western style toilet seat and seat cover opening-closing device according to the present invention shown in FIG. 19.

FIGS. 19 and 20 show further another embodiment of the opening-closing device. In the opening-closing device E of the present embodiment, according to the drawings, the hinge case 45 and the leg 46 are unitarily formed; a pair of hinge cases 45are inserted in the case holder 48 as shown in the embodiment previously shown, with a projecting key 45*a* formed on the hinge case 45 fitted in a keyway 48*a*; in a space located between the hinge cases 45, 45 a lockding piece 47 is mounted by pressing; and furthermore projecting keys 47*a* formed at the front and rear sides are fitted in keyways 48*a*, thereby securing the hinge cases 45, 45 in the case holder 48.

The present embodiment, therefore, has the advantage that the hinge cases 45, 45 can easily be mounted in the case holder 48.

What is claimed is:

1. An opening-closing device for a Western style toilet seat and seat cover, comprising: a pair of hinge cases adapted to be mounted at a predetermined spacing at the rear upper end of a Western style toilet bowl; each hinge case defining an interior chamber; a rotating shaft for said seat and a rotating shaft for said seat cover both rotatably mounted within at least one of said chambers of said hinge cases; a seat mounting section rotatably mounted on said rotating shaft for said seat; a seat cover mounting section rotatably mounted on said rotating shaft for said seat cover; and rotation control means within said hinge case mounted on said rotating shaft for said seat and said rotating shaft for said seat cover, to thereby prevent sudden drop of said seat and seat cover.

2. An opening-closing device for a Western style toilet seat and seat cover according to claim 1, wherein said rotation control means is a cam mechanism with a compression spring.

3. An opening-closing device for a Western style toilet seat and seat cover according to claim 2, wherein said cam mechanism is comprised of a stationary cam secured on a partition wall provided in said hinge case with said rotating shaft inserted in the center; a rotating-sliding cam which faces said stationary cam and is slidable in the axial direction of said rotating shaft while rotating together with said rotating shaft; and a compression spring for pressing said rotating-sliding cam toward said stationary cam.

4. An opening-closing device for a Western style toilet seat and seat cover according to claim 1, wherein said rotation control means is a torsion spring.

5. An opening-closing device for a Western style toilet seat and seat cover according to claim 1, wherein said rotation control means is a rotation damper.

6. An opening-closing device for a Western style toilet seat and seat cover according to claim 1, wherein said rotation control means is a friction mechanism.

7. An opening-closing device for a Western style toilet seat and seat cover according to claim 1, wherein said hinge cases, when mounted on the rear upper end of a toilet bowl, are removably mounted in a hinge case holder.

8. An opening-closing device for a Western style toilet seat and seat cover according to claim 7, wherein said hinge cases, when removably mounted to said case holder, comprise a leg for holding said hinge case to the rear upper end of a Western style toilet bowl thereby restrict the vertical movement of said hinge cases fitted in said case holder, and a locking piece inserted between said hinge cases in said case holder for restricting the lateral movement of said hinge case fitted in said case holder.

9. An opening-closing device for a Western style toilet seat and seat cover according to claim 7, wherein when said hinge cases are removably mounted on said case holder, said hinge cases are formed unitarily with a leg and are fitted in said case holder; and a locking piece is fitted between said hinge cases to restrict the lateral movement of said hinge cases.

* * * * *